US008378903B2

(12) United States Patent
Baucom et al.

(10) Patent No.: US 8,378,903 B2
(45) Date of Patent: Feb. 19, 2013

(54) ANTENNA APPARATUS AND METHODS OF USE THEREFOR

(75) Inventors: Charlie E. Baucom, Greenville, TX (US); Edward K. Lule, McKinney, TX (US)

(73) Assignee: L-3 Communications Integrated Systems L.P., Greenville, TX (US)

( * ) Notice: Subject to any disclaimer, the term of this patent is extended or adjusted under 35 U.S.C. 154(b) by 702 days.

(21) Appl. No.: 12/584,646

(22) Filed: Sep. 9, 2009

(65) Prior Publication Data

US 2011/0057848 A1 Mar. 10, 2011

(51) Int. Cl.
*H01Q 1/28* (2006.01)
*H01Q 9/16* (2006.01)

(52) U.S. Cl. ..... 343/705; 343/806; 343/818

(58) Field of Classification Search ..... 343/705, 343/708, 795, 797, 806, 818
See application file for complete search history.

(56) References Cited

U.S. PATENT DOCUMENTS 3,701,157 A 10/1972 Uhrig
3,737,906 A 6/1973 Maynard
6,211,840 B1 * 4/2001 Wood et al. ..... 343/793
6,344,834 B1 2/2002 Josypenko
7,362,279 B2 4/2008 Locatori
2009/0295667 A1 * 12/2009 Ma et al. ..... 343/795

OTHER PUBLICATIONS

Nelder et al., "A Simplex Method for Function Minimization", The Computer Journal 7(4):308-313, 1965, 6 pgs.
Wikipedia, "Computional Electromagnetics", Printed from Internet Jul. 7, 2009, 10 pgs.
Haupt et al, Practical Genetic Algorithm, "The Binary Genetic Algorithm", Chapter 2, 1998, 24 pgs.

* cited by examiner

*Primary Examiner* — Robert Karacsony
(74) *Attorney, Agent, or Firm* — O'Keefe, Egan, Peterman & Enders LLP

(57) ABSTRACT

Antenna apparatus and methods of using the same that employ a broadband, planar, single feed ultra high frequency satellite communication (UHF SATCOM) antenna device which may be mounted on composite or other non-metallic and non-electrically conductive surfaces. The antenna apparatus may be implemented using a single antenna feed and impedance matching network with a low profile antenna shape that optimizes over-the-horizon gain, with no requirement for a ground plane. The antenna apparatus may also be implemented to cover the entire UHF SATCOM frequency band using a single antenna feed.

17 Claims, 10 Drawing Sheets

ANTENNA APPARATUS AND METHODS OF USE THEREFOR

FIELD OF THE INVENTION

This invention relates generally to RF signal communication, and more particularly to antennas for RF signal communication.

BACKGROUND OF THE INVENTION

To improve aircraft performance, aircraft manufacturers are increasingly turning to composite materials (e.g., Kevlar, epoxy graphite, carbon laminate, carbon sandwich, fiberglass, etc.) rather than traditional aluminum materials for aircraft construction. For example, it has been common to employ an aluminum fuselage and wings in combination with composite materials used for control surfaces, engine nacelles, etc. However, newer aircraft are now being built with composite fuselage and wing materials. As an example, the Boeing 787 employs an all-composite fuselage, making it the first airliner in production to employ composite materials for fifty percent of its construction.

Aircraft, such as airliners, are often equipped with satellite communication (SATCOM) capabilities that require antenna devices to be mounted to an external surface of the aircraft. The UHF SATCOM frequency bands are defined as 244 to 270 MHz (10.2% bandwidth) downlink frequencies, and 292 to 317 MHz 8% bandwidth) uplink frequencies. Conventional ultra-high frequency (UHF) SATCOM antenna devices employ two antennas: a first antenna (e.g., quadrifilar helix or crossed dipole antenna) for high angle (overhead) UHF satellite communications, and a second monopole antenna for low angle (horizon) UHF satellite communications. Each one of these antenna devices tends to be bandwidth limited. The performance (i.e., VSWR, gain, etc.) of an antenna mounted on a composite surface is considerably different than the same antenna mounted on a metallic structure. Therefore, conventional aircraft communication antennas are mounted on metal aircraft surfaces (e.g., aluminum fuselage surfaces) rather than non-metallic composite surfaces of an aircraft that is of mixed metallic/composite material construction.

FIG. 1 illustrates one example of a planar UHF SATCOM antenna device 100 of the prior art that is coupled to a conductive metal surface 150 of an aircraft, and as may be contained within an aerodynamic enclosure such as a radome. As shown in FIG. 1, antenna device 100 includes a base plate 120 and a high angle UHF SATCOM dipole antenna structure that includes a first leg structure 102 and a second (floating) leg structure 104 that are coupled to a first UHF SATCOM feed 106 and a first UHF SATCOM ground 108. Conductive metal surface 150 of the aircraft acts as a ground plane for antenna device 100.

As shown in FIG. 1, a cylindrical feed member 117 (i.e., 0.141" diameter coaxial cable having outer metallic shield 119 and inner center core 107 electrically coupled together with dielectric insulating material therebetween) is connected between first UHF SATCOM feed 106 and first leg 102 via conductor 109, and first UHF SATCOM ground 108 is directly connected to second antenna leg 104 through electrically conductive base plate 120. Each of first and second leg structures 102 and 104 are manufactured from a conductive outer skin of copper that surrounds a lightweight foam core. A capacitive director structure 116 is provided as shown and includes a conductive copper layer 114 that is separated from first and second leg structures 102 and 104 by a thin dielectric layer 112.

Still referring to FIG. 1, UHF SATCOM antenna device 100 also includes a low angle UHF SATCOM monopole antenna structure that includes a folded monopole antenna element 130 that is coupled to a second UHF SATCOM feed 136, with second UHF SATCOM ground 138 coupled to base plate 120 as shown. The terminal end of folded monopole antenna element 130 is spaced from base plate 120 by dielectric spacer 140 as shown. During operation, satellite communications are switched between high angle UHF SATCOM dipole antenna structure and low angle UHF SATCOM dipole antenna structure as needed based on satellite angle relative to the aircraft.

SUMMARY OF THE INVENTION

Disclosed herein is antenna apparatus and methods of using the same that may be employed for both high angle and low angle UHF SATCOM communications. The disclosed antenna apparatus may be implemented in one embodiment as a broadband, planar, single feed UHF SATCOM antenna device that is relatively compact and lightweight with excellent Radio Frequency (RF) characteristics for use on composite or other non-metallic ground surfaces, e.g., such as outer fuselage surface of high speed fixed wing airborne vehicles and helicopter rotor installations, as well as installation on trucks, automobiles, spacecraft, trains, ships, boats, etc. In one exemplary embodiment, the disclosed antenna apparatus may be implemented as a UHF SATCOM antenna having aerodynamic features well suited for use on composite skin airborne vehicles, e.g., such as an all-composite fuselage airliner like the Boeing 787.

In one exemplary embodiment, the disclosed antenna apparatus may be implemented using a unique antenna feed and impedance matching system. The antenna apparatus may further be configured as a planar antenna structure, making the antenna lightweight with good aerodynamic characteristics. A low profile antenna shape design may further be employed to optimize over-the-horizon gain. Advantageously, no ground plane is required for the disclosed antenna apparatus to operate effectively, i.e., the disclosed antenna apparatus may be operatively mounted on a non-metallic/composite surface with no ground plane.

Advantageously, the disclosed antenna apparatus may be implemented in one embodiment to cover the entire UHF SATCOM frequency band using a single antenna feed, and the antenna apparatus may be further implemented in one embodiment with a capacitively loaded antenna feed to provide the antenna apparatus with broadband frequency response characteristics and relatively low voltage standing wave ratio (VSWR), e.g., a VSWR of less than about 2.0:1 across its operating band using a single antenna feed on a non-metallic surface.

In one respect, disclosed is a vehicle-based UHF SATCOM communication system, including: a vehicle having a fuselage with a surface that is non-electrically conductive; a UHF SATCOM dipole antenna apparatus mounted to the non-conductive vehicle fuselage with no ground plane coupled therebetween; and a UHF SATCOM communication apparatus mounted to or contained within the vehicle, the UHF SATCOM communication system being coupled to the UHF SATCOM dipole antenna apparatus by a single UHF SATCOM feed, the UHF SATCOM dipole antenna apparatus providing simultaneous high angle and low angle UHF SATCOM communication capability to the UHF SATCOM communication system through the single UHF SATCOM feed.

In another respect, disclosed herein is a communication method, including: providing a vehicle having a fuselage with a surface that is non-electrically conductive; providing a UHF SATCOM dipole antenna apparatus mounted to the non-conductive vehicle fuselage with no ground plane coupled therebetween; providing a UHF SATCOM communication apparatus mounted to or contained within the vehicle, the UHF SATCOM communication system being coupled to the UHF SATCOM dipole antenna apparatus by a single UHF SATCOM feed, the UHF SATCOM dipole antenna apparatus providing simultaneous high angle and low angle UHF SATCOM communication capability to the UHF SATCOM communication system through the single UHF SATCOM feed; and at least one of transmitting UHF SATCOM communication signals from the UHF SATCOM communication apparatus via the UHF SATCOM dipole antenna apparatus, receiving UHF SATCOM communication signals at the UHF SATCOM communication apparatus via the UHF SATCOM dipole antenna apparatus, or a combination thereof.

In another respect, disclosed herein is a UHF SATCOM dipole antenna apparatus, including: a first conductive planar antenna element electrically coupled between a single UHF SATCOM feed and a conductive base plate, the first planar antenna element having an inboard leg section coupled between a first end of the first planar element and an outboard leg section of the first planar antenna element, the inboard leg section of the first planar antenna element having a longitudinal axis extending between the first end of the first planar element and the outboard leg section of the first planar element, the single UHF SATCOM feed being electrically coupled to the first end of the first planar antenna element; a second conductive planar antenna element coupled to the conductive base plate in floating relationship to the first planar antenna element with a space therebetween, the second planar antenna element having an inboard leg section coupled between a first end of the second planar element and an outboard leg section of the second planar antenna element, the inboard leg section of the second planar antenna element having a longitudinal axis extending between the first end of the second planar element and the outboard leg section of the second planar element, a single UHF SATCOM ground being electrically coupled to the conductive base plate; and a capacitive director structure having a conductive director and being coupled across the space between the first and second planar antenna elements, the capacitive director structure having a length coextensive with the length of the inboard leg sections of each of the first and second planar antenna elements, the capacitive director structure also having a length only partially extensive with the length of the outboard leg sections of each of the first and second planar antenna elements.

In the implementation of the disclosed UHF SATCOM dipole antenna apparatus and methods, the longitudinal axis of the first leg section of the second planar antenna element may be oriented substantially parallel to the longitudinal axis of the first leg section of the first planar antenna element in back to back relationship such that the second planar antenna element extends in a direction substantially opposite from a direction in which the first planar element extends, the outboard leg section of the first planar antenna element may have a longitudinal axis that extends at an angle ($\alpha$) relative to the longitudinal axis of the inboard leg section of the first planar element, and wherein the outboard leg section of the second planar antenna element has a longitudinal axis that extends at the angle ($\alpha$) relative to the longitudinal axis of the inboard leg section of the second planar element, and the angle ($\alpha$) may be operative to provide the antenna apparatus with simultaneous high angle and low angle UHF SATCOM communication capability through the single UHF SATCOM feed when the conductive base plate is coupled to the non-conductive surface of the vehicle with no ground plane coupled therebetween.

DESCRIPTION OF ILLUSTRATIVE EMBODIMENTS

Figure 2:
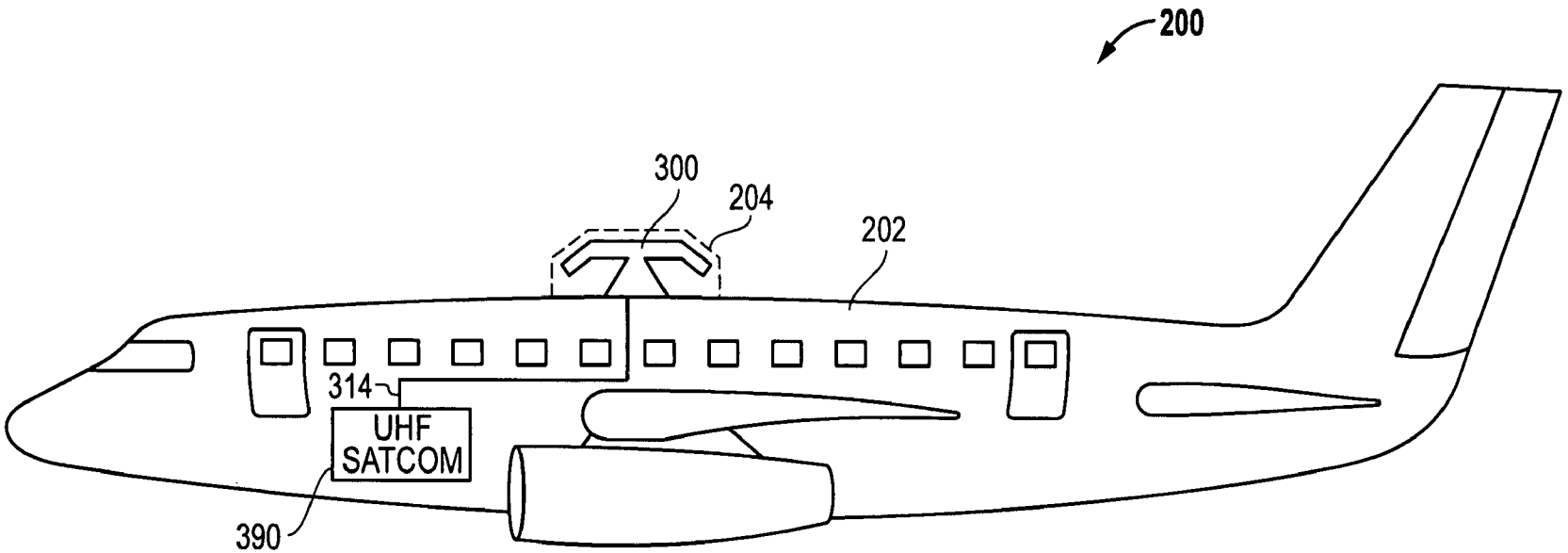
FIG. 2 illustrates a vehicle-based UHF SATCOM communication system according to one embodiment of the disclosed apparatus and methods.

FIG. 2 illustrates a vehicle-based UHF SATCOM communication system 200 that includes an antenna apparatus 300 mechanically mounted to a non-conductive surface of an aircraft fuselage 202 (e.g., composite material fuselage made from Kevlar, epoxy graphite, carbon laminate, carbon sandwich, fiberglass, etc.) with no ground plane according to one exemplary embodiment of the disclosed apparatus and methods. Although illustrated mounted on top of aircraft fuselage 202, it will be understood that such an antenna apparatus 300 may be mounted in any other suitable location on a fuselage of an aircraft or another type of vehicle, e.g., top or sides of fuselage, fuselage underside, etc. Also shown in FIG. 2 is a protective radome 204 that encloses antenna apparatus 300, and UHF SATCOM communication apparatus 390 that is contained within aircraft fuselage 202 and coupled to antenna apparatus 300 by a single UHF SATCOM feed 314.

Examples of UHF SATCOM communication apparatus 390 include, but are not limited to, transceivers such as PRC-117 and ARC-231, and transmitters such as Joint Tactical Terminals (JTT). The disclosed antenna apparatus 300 may be implemented in one exemplary embodiment with a communication apparatus 390 configured as a transceiver that employs UHF SATCOM frequency bands from 244 to 270 MHz (10.2% bandwidth) as downlink frequencies, and that employs UHF SATCOM frequency bands from 292 to 317 MHz (8% bandwidth) as uplink frequencies. However it will be understood that antenna apparatus 300 maybe alternatively configured for use with other frequency bands as well.

Figure 3:
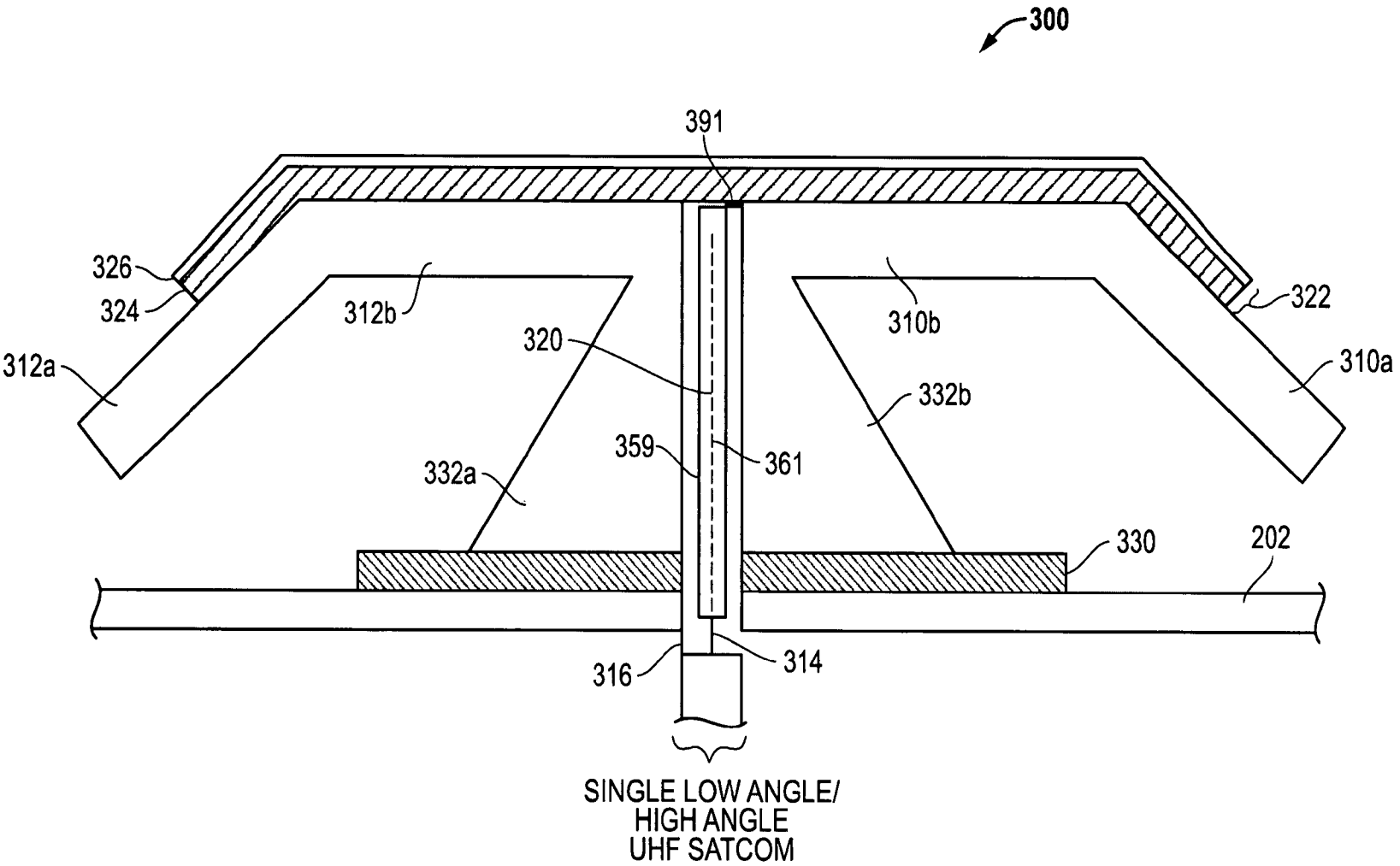
FIG. 3 illustrates a cross sectional side view of an antenna apparatus according to one embodiment of the disclosed apparatus and methods.
Figure 4:
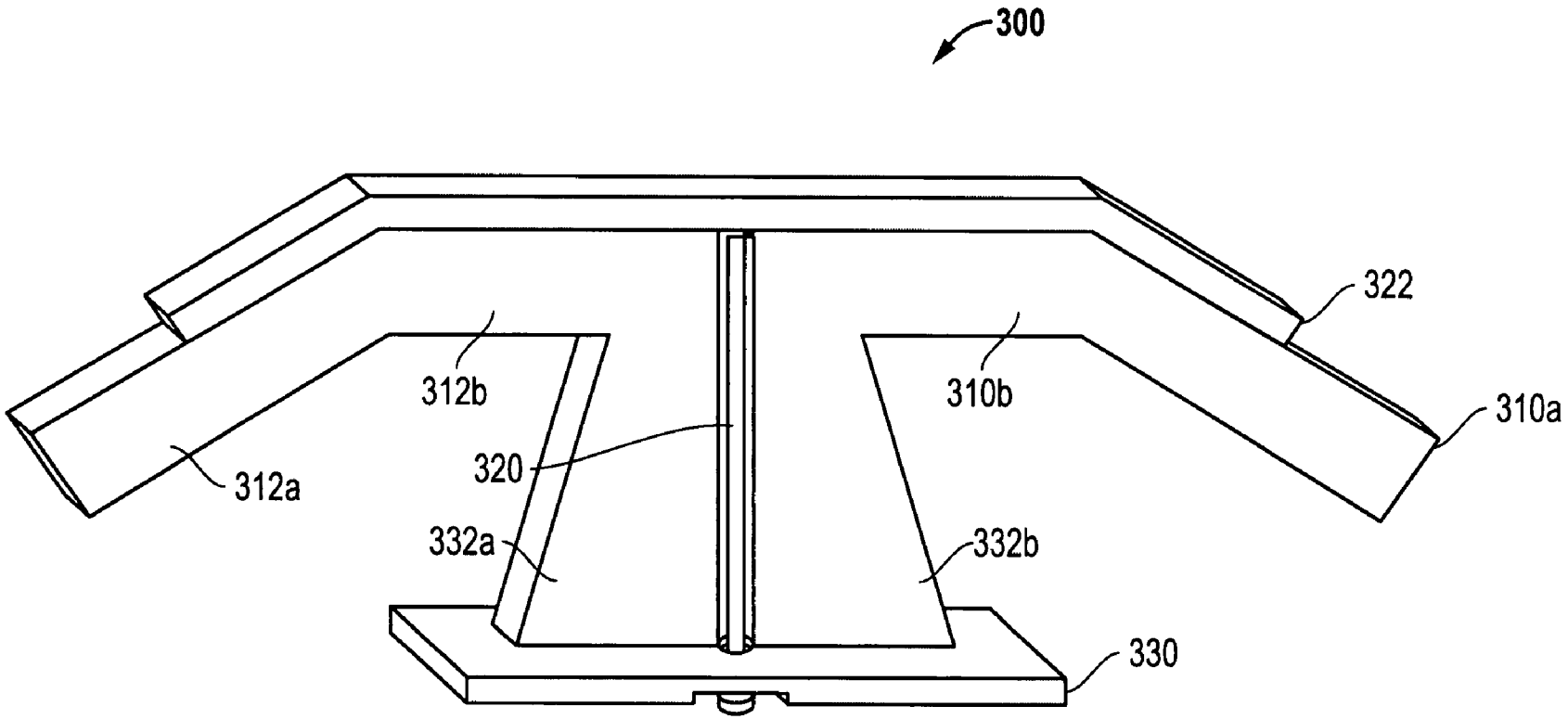
FIG. 4 illustrates a perspective view of an antenna apparatus according to one embodiment of the disclosed apparatus and methods.

FIG. 3 illustrates a cross sectional side view of antenna apparatus 300 configured as a planar dipole antenna apparatus according to one exemplary embodiment, and FIG. 4 illustrates a perspective view of the antenna apparatus 300 of FIG. 3. As shown in FIG. 3, antenna apparatus 300 includes an electrically conductive base plate 330 that is coupled to a non-conductive structure 202 (e.g., composite material aircraft fuselage) in this embodiment. As further shown in FIG. 3, antenna apparatus includes two planar dipole elements in the form of a first leg structure 310 (composed of sections 310*a* and 310*b*) and a second leg structure 312 (composed of sections 312*a* and 312*b*) that are each coupled to the upper end of a respective antenna base structure 332*a* or 332*b*. In this embodiment, each of antenna base structures 332*a* and 332*b* may be provided with a relative wide base that narrows toward the upper end. Antenna apparatus 300 is also coupled to single UHF SATCOM feed 314 and a single UHF SATCOM ground 316 as shown. Second leg structure 312 floats relative to UHF SATCOM feed 314 as shown, providing improved impedance matching characteristics.

As further shown in FIG. 3, a cylindrical center feed member 320 (e.g., 0.25" diameter coaxial cable with annular Teflon dielectric insulator having its outer tin plated aluminum metallic shield conductor 359 and its center core conductor 361 electrically coupled together by, for example, an electrically conductive metal disc soldered between these conductors) is electrically connected between single UHF SATCOM feed 314 and first antenna leg 310 (including sections 310*a* and 310*b*) via electrical conductor 391. Single UHF SATCOM ground 316 is directly connected to second antenna leg 312 (including sections 312*a* and 312*b*) conductive base plate 330. It will be understood that feed member 320 may be configured in any other suitable manner, e.g., as a solid conductor, and that larger diameter of feed member 320 may be selected to provide better impedance matching characteristics.

In this exemplary embodiment, each of first and second leg structures 310 and 312 may be manufactured from a conductive outer skin (e.g., 0.0014 inches thick copper or other suitable conductive sheet metal such as aluminum) that surrounds a lightweight core (e.g., 0.2 inches thick Klegecell foam available from DIAB Inc. of DeSoto, Tex. or other suitable core material such as Divinycell HT61 foam also available from DIAB Inc. of DeSoto, Tex.) for a total planar thickness (T) of about 0.2 inches. For example, first and second leg structures 310 and 312 of the planar dipole antenna apparatus 300 may be connected together using a copper metallic strip having dimensions of about 2 inches wide by about 6 inches long. However, it will be understood that other materials may be employed for the outer skin and/or core materials depending on the weight and strength requirements for a given application. For example, a stronger and/or more dense material such as wood or fiberglass may be employed as a core material in those applications where antenna strength is considered more important than light weight performance Moreover, in other embodiments, either one or both of first antenna leg 310 and second antenna leg 312 may be constructed of a single piece of suitably conductive material.

Still referring to FIG. 3, first antenna leg structure 310 includes a substantially horizontal inboard leg section 310*b*, i.e., having a longitudinal axis that is oriented substantially parallel to the plane of aircraft fuselage 202 to which antenna apparatus 300 is coupled. As shown, inboard leg section 310*b* is mechanically and conductively coupled between feed member 320 and an outboard leg section 310*a* which has a longitudinal axis that is oriented at a downward angle (i.e., downwardly angled in a direction toward aircraft fuselage 202) relative to inboard leg section 310*b*. As further shown, second antenna leg structure 312 includes a substantially horizontal inboard leg section 312*b*, i.e., having a longitudinal axis that is oriented substantially parallel to the plane of aircraft fuselage 202 to which antenna apparatus 300 is coupled. As shown, inboard leg section 312*b* is mechanically and conductively coupled at its distal end to an outboard leg section 312*a* which has a longitudinal axis that is oriented at a downward angle (i.e., downwardly angled in a direction toward aircraft fuselage 202) relative to inboard leg section 312*b*. The substantially horizontal inboard leg sections 310*b* and 312*b* provide high angle communication capability, and the downward angled outboard leg sections 310*a* and 312*a* provide low angle communication capability.

Still referring to FIG. 3, a capacitive director structure 322 is coupled as shown across the top of antenna apparatus 300, and includes a conductive director layer 326 (e.g., 0.0014 inch thick copper strip) that is separated from first and second leg structures 310 and 312 by a dielectric layer 324 (e.g., such as Klegecell Type 75 red foam available from DIAB Inc. of DeSoto, Tex. or other suitable insulating dielectric material having, for example, a dielectric constant of from about 1.09 to about 1.14, and loss tangent of from about 0.0017 to about 0.002). With regard to conductive director layer 326, it will be understood that, other suitable conductive materials may be employed besides copper, e.g., such as aluminum. As further shown in FIG. 3, the director structure 322 of this embodiment overlays the entire length of inboard leg sections 310*b* and 312*b*, and partially overlays the length of each of outboard leg sections 310*a* and 312*a*. In this regard, the director contributes to the overall impedance characteristics of the antenna by introducing a capacitive element in the circuit. In operation, antenna apparatus 300 is excited in such a way that the electric field from the antenna feed 314 and feed member 320 couples into both the director 326 and dipole elements 310 and 312, and vice-versa. In this way, director 326 re-radiates impinging electromagnetic radiation for reception, and vice-versa for transmitted electromagnetic radiation.

Figure 5:
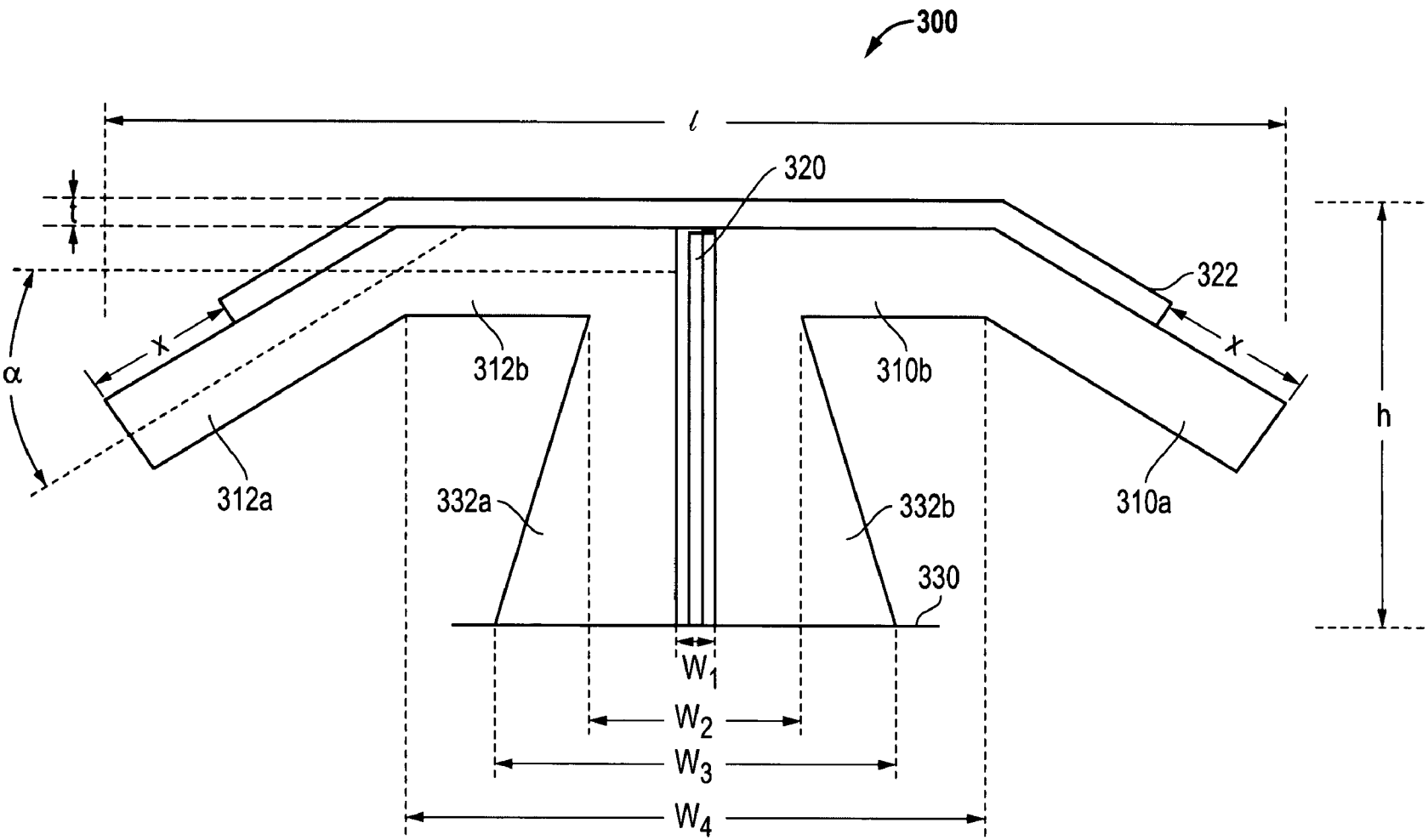
FIG. 5 illustrates dimensional configuration for an antenna apparatus according to one embodiment of the disclosed apparatus and methods.

FIG. 5 illustrates dimensional configuration for an antenna apparatus 300 as it may be configured according to one exemplary embodiment to achieve a 28.6% (240 to 320 MHz) operating bandwidth, covering the 244-318 MHz UHF SATCOM frequency range. Overall length (l) of antenna apparatus 3000 from the tip of outboard leg section 310*a* to the tip of outboard leg section 312*a* may be initially selected to be about 20 inches, which represents half of the wavelength ($\lambda$) at the center frequency of 280 MHz. This value may vary for different wavelengths ($\lambda$) of interest, and it will be understood that other values of length (l) relative to a given wavelength ($\lambda$) may be selected as further described herein, e.g., to reduce the volume of the antenna structure 300 while improving coverage and maintaining impedance matching characteristics. As further shown in FIG. 5, the outboard leg section of each of first leg structure 310 and second leg structure 312 may be angled relative to its respective inboard leg section by an angle ($\alpha$) which may be selected to provide for good antenna gain, and voltage standing wave ratio (VSWR) performance (e.g., VSWR of less than about 2.0:1 across its operating band using a single antenna feed on a non-metallic surface), while at the same time providing an angled configuration that acts to optimize the overall shape of the antennal apparatus 300 by making it more compact. In one exemplary embodiment, angle (α) of about 30° may be selected for good gain, VSWR performance and optimized shape. However, as described below, both angle (α) and length (l) may be varied to optimize the configuration of antenna apparatus 300 for different applications. Further thickness (t) of capacitive director structure may be varied to control VSWR.

In one embodiment, the disclosed antenna apparatus 300 may be coupled to transmitting and receiving circuits having a nominal impedance of 50 Ohms. As with other antennas, if the impedance of antenna apparatus 300 differs substantially from that of the coupled transmitting/receiving circuit, this may lead to an impedance mismatch, which in turn may result in energy being lost on transmission/reception in the communication device. Therefore, an impedance matching network may be used to match the impedance of antenna apparatus 300 to the impedance of the transmitting/receiving circuits. In this regard, antenna impedance match quality is determined by the VSWR of antenna apparatus 300 at each of the frequencies of interest.

One suitable method for computer aided modeling of antennas is the approximation of the current distribution on the antenna device. Typically antenna computer aided modeling is accomplished by the decomposition of the antenna model into segments, followed by the solution for currents on these segments. Several methods exist that can be used for antenna computer aided modeling, one of the most popular method is a numerical computational method of solving linear partial differential equations which have been formulated as integral equations, known as Method of Moments (MoM). One example of antenna computer aided modeling tool using MoM technique is available as "FEKO" electromagnetic (EM) analysis software suite from EM Software & Systems (USA) Inc. of Hampton, Va. The word "FEKO" is derived from the German phrase FEidbet-echnung hei Korpern nñt bciieger Oberflache ("field computations involving bodies of arbitrary shapes").

In one exemplary embodiment, overall antenna apparatus length (l), as well as angle (α) of inboard leg sections 310*a* and 312*a* of antenna apparatus 300 may be varied while at the same time employing optimization algorithms using MoM for electromagnetic analysis to search for value of angle (α) (e.g., from about 20 degrees to about 45 degrees) and value of length (l) (e.g., from about 10 inches to about 20 inches) that provides good over the horizon (OTH) coverage while maintaining impedance matching consistent with the baseline antenna design. Examples of such optimization algorithms that may be so employed include hill climbing search methods such as Simplex Nelder-Mead Mathematical algorithm where the final optimum is significantly influenced by the starting value of the user (see J. A. Nelder and R. Mead, *A Simplex Method for Function Minimization*), Computer Journal 7 (1965), pp. 308-313, which is incorporated herein by reference); and genetic algorithms that provide a robust stochastic search method modeled on Darwinian principles of natural selection and evolution (see Randy L Haupt and Sue Ellen Haupt, *Practical Genetic Algorithms*, John Wiley and Sons (1998), pp. 25-65, which is incorporated herein by reference).

It will be understood that in one embodiment, angle (α) may vary from about 20 degrees to about 45 degrees, although values of angle (α) may be less than about 20 degrees or more than about 45 degrees as may be suitable for the individual case to provide both high angle (overhead) UHF satellite communications and low angle (horizon) UHF satellite communications via a single (and common) UHF SATCOM feed 314. In one exemplary embodiment, angle (α) may be selected to provide for good horizon coverage to about 40 degrees above the horizon, although other values of angle (α) and horizon coverage angle may be achieved, e.g., to provide high angle coverage of from about 40 degrees to 90 degrees above the horizon simultaneous with providing low angle coverage of from about 40 degrees to about 0 degrees above the horizon.

Still referring to FIG. 5, height (h) of antenna apparatus 300 may be selected in one embodiment based on a quarter wavelength at the frequency of operation. For example height (h) may be one fourth of the wavelength (λ/4) or about 10 inches, which represents a quarter of the wavelength (λ) at the center frequency of 280 MHz. As with length (l), the value of height (h) may vary for different wavelengths (λ) of interest, it being understood that other values of height (h) relative to a given wavelength (λ) may be selected. In the illustrated embodiment, width ($W_2$) of upper end of each of antenna base structures 332*a* and 332*b* may be less than width ($W_3$) of the base or lower end of each of antenna base structures 332*a* and 332*b* as shown for purposes of antenna design requirements of a particular application to meet aerodynamic and mechanical installation criteria. Also shown in FIG. 5 is width ($W_4$) which represents the length of antenna apparatus 300 as measured between the terminal ends of inboard leg sections 310*a* and 312*a*.

Table 1 summarizes possible dimensional values for antenna apparatus 300 of FIG. 5 according to the exemplary embodiments described above, it being understood that other dimensions may be employed.

TABLE 1

| Dimensional Component | Exemplary Value For This Embodiment | Exemplary Range of Possible Values |
|---|---|---|
| angle (α) | about 30° | about 20° to about 45° |
| length (l) | about 20 inches | about 10 inches to about 20 inches |
| height (h) | about 10 inches | about 8.5 inches to about 10 inches |
| leg structure spacing ($W_1$) | about 0.5 inches | may vary according to dimensions of center feed member 320 |
| width ($W_2$) | about 3.1 inches | about 3.09 inches to 3.11 inches |
| width ($W_3$) | about 6.0 inches | about 5.9 inches to 6.1 inches |
| width ($W_4$) | about 7.84 inches | about 7.8 inches to 7.9 inches |
| director thickness (t) | about 0.42 inches | about 0.4 inches to 0.45 inches |
| exposed leg section length (x) | about 3 inches | about 2.9 inches to 3.1 inches |
| planar thickness (T) of antenna apparatus 300 | about 0.2 inches | about 0.19 inches to 0.21 inches |

Figure 6B:
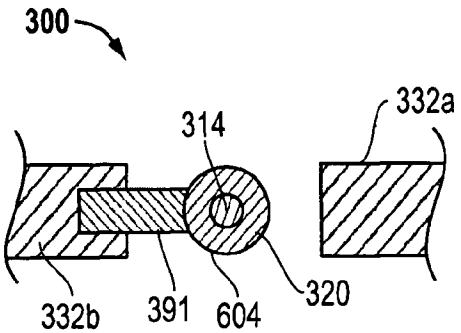
FIG. 6B illustrates a cross-sectional top view of an antenna apparatus according to one embodiment of the disclosed apparatus and methods.
Figure 6A:
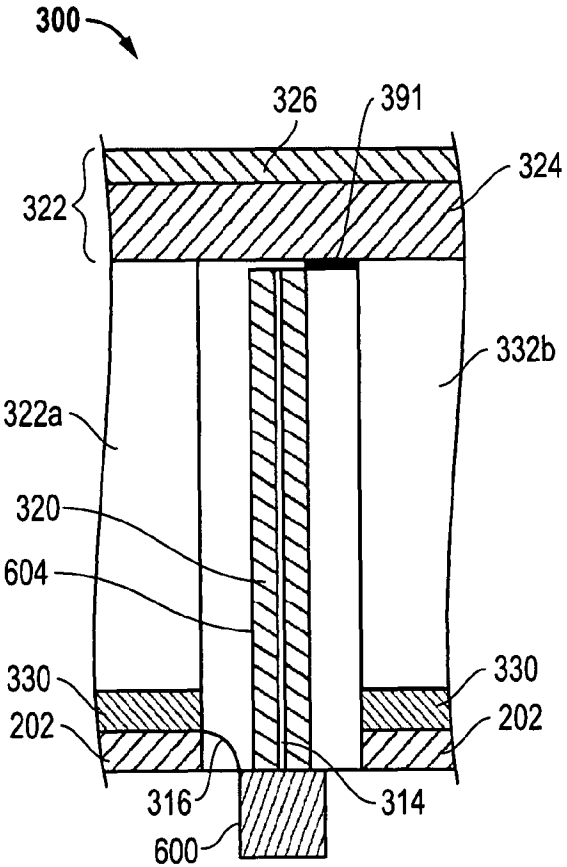
FIG. 6A shows a partial side view of an antenna apparatus according to one embodiment of the disclosed apparatus and methods.

FIG. 6A shows a partial side view of antenna apparatus 300, and illustrates in more detail the antenna feed assembly configuration that may be employed in one exemplary embodiment. As shown, antenna apparatus is fed in this embodiment using a coaxial connector 600 (e.g., UG58A/U connector) whose center conductor is electrically coupled to the center conductor 314 of feed line assembly of center feed member 320 (e.g., UT-250-A-TP rigid coax cable) with the outer shield of connector 600 electrically coupled to base plate 330 of antenna apparatus 300. As previously mentioned in relation to FIG. 3, center conductor 314 of center feed member 320 is electrically coupled to outer metallic shield 604 of center feed member 320. FIG. 6B illustrates a cross-sectional top view of the antenna apparatus of FIG. 6A, showing center feed member 320 electrically coupled to first antenna leg 310 as previously described in relation to FIG. 3. Further UHF SATCOM ground 316 of coaxial connector 600 is electrically coupled to antenna base structure 332*a* and second antenna leg 312 (including sections 312*a* and 312*b*) through base plate 330.

As further illustrated, VSWR and input impedance may be optimized across the operating band (e.g., 240-320 MHz in this exemplary embodiment) by the presence of a capacitive director structure 322 coupled as shown partially across the top of antenna apparatus 300 in a manner as previously described, e.g., to drive impedance to about 50Ω with VSWR of from about 1:1 to about 2:1 in one embodiment. As shown in FIG. 6, capacitive director structure 322 includes a conductive director layer 326 that is separated from first and second leg structures 310 and 312 by a dielectric layer 324. As so configured, the director structure 322 capacitively loads the antenna apparatus 300, tuning the impedance characteristics of the antenna apparatus 300, and increasing the bandwidth of the antenna apparatus 300. In one exemplary embodiment, the director structure 322 may be constructed of a metallic (e.g., copper) strip for director layer 326 that is on top of a Klegecell foam block dielectric 324 (e.g., that is about 0.42 in. thick and about 0.39 in wide). Dielectric material for the foam block may be, for example, a material having a very low dielectric constant and loss tangent (e.g., such as Klegecell Type 75 red foam with a dielectric constant of 1.09 and loss tangent of 0.0017). The capacitance contribution of the director may be given by the following equation:

$$C=\in_o\in_r(A/d)$$

where:

A is the surface area of the director 326

$\in_o$ is the relative static permittivity (dielectric constant) of dielectric 324

$\in_r$ is the permittivity of free space ($8.85\times10^{-12}$ Farad/meter)

d is the distance of the director 326 from radiator

Figure 7:
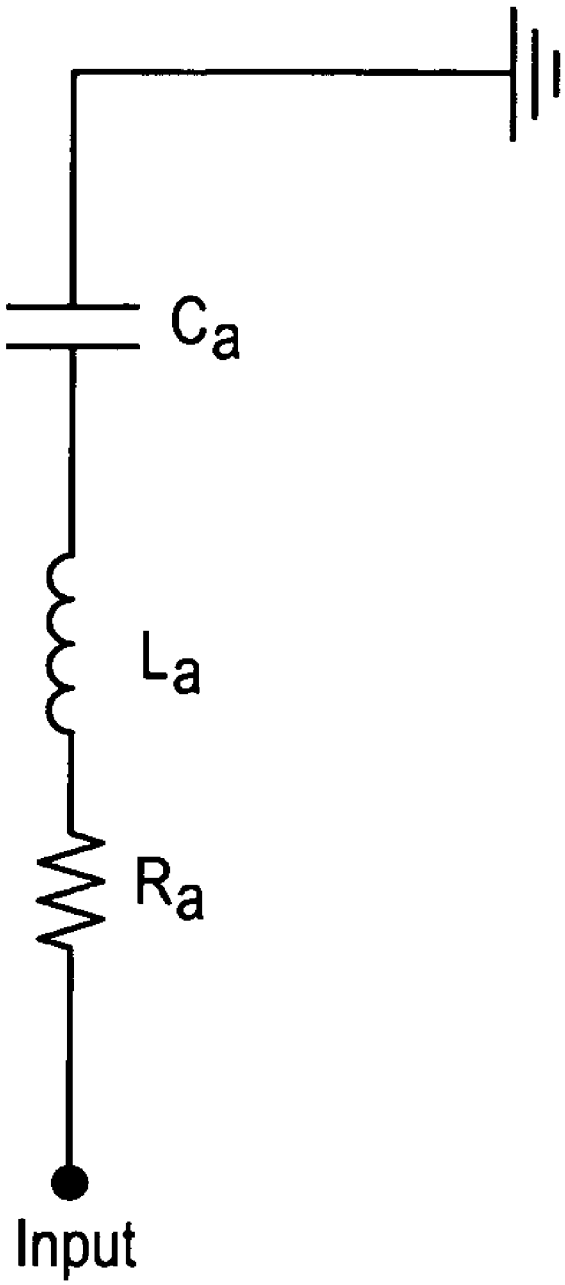
FIG. 7 shows an equivalent circuit of an antenna apparatus according to one embodiment of the disclosed apparatus and methods.

FIG. 7 shows an equivalent circuit of the antenna apparatus 300 having resistance $R_a$, inductance $L_a$, and with Ca representing the capacitance contribution of the director structure 322. By adjusting the distance of director from the antenna's leg structures 310 and 312, the impedance characteristics of the antenna apparatus 300 may be tuned, e.g., with reference to a 50 ohm connection. The exemplary impedance matching technique of the disclosed system and methods provides a broadband antenna device, with low VSWR across the device operating bandwidth.

Figure 8:
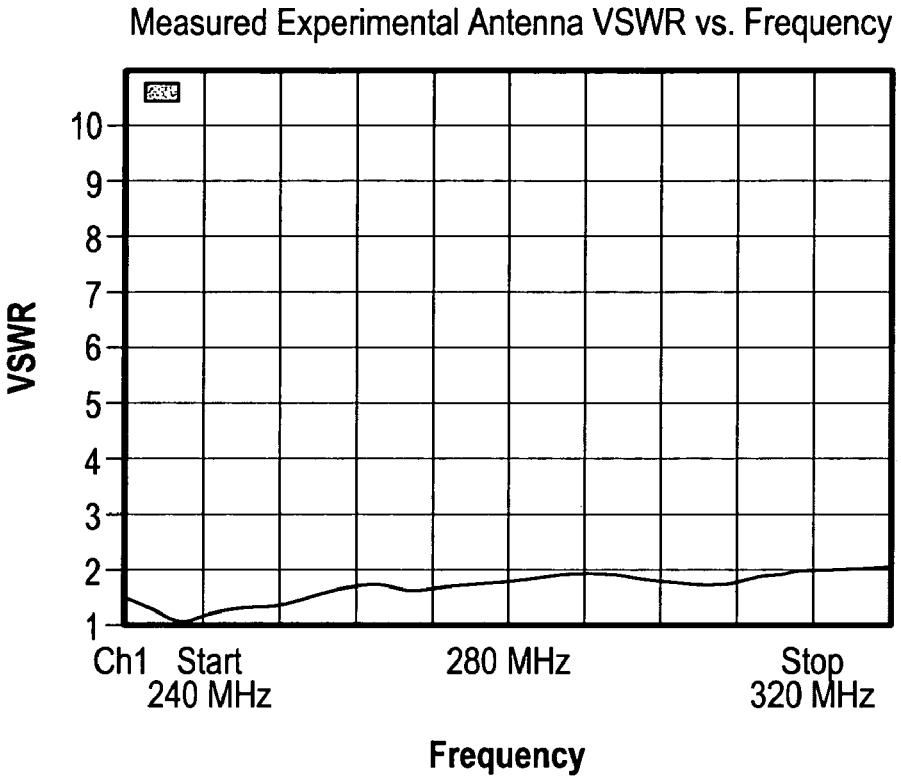
FIG. 8 is a plot of experimental (measured) VSWR versus frequency for an antenna apparatus according to one embodiment of the disclosed apparatus and methods.
Figure 9:
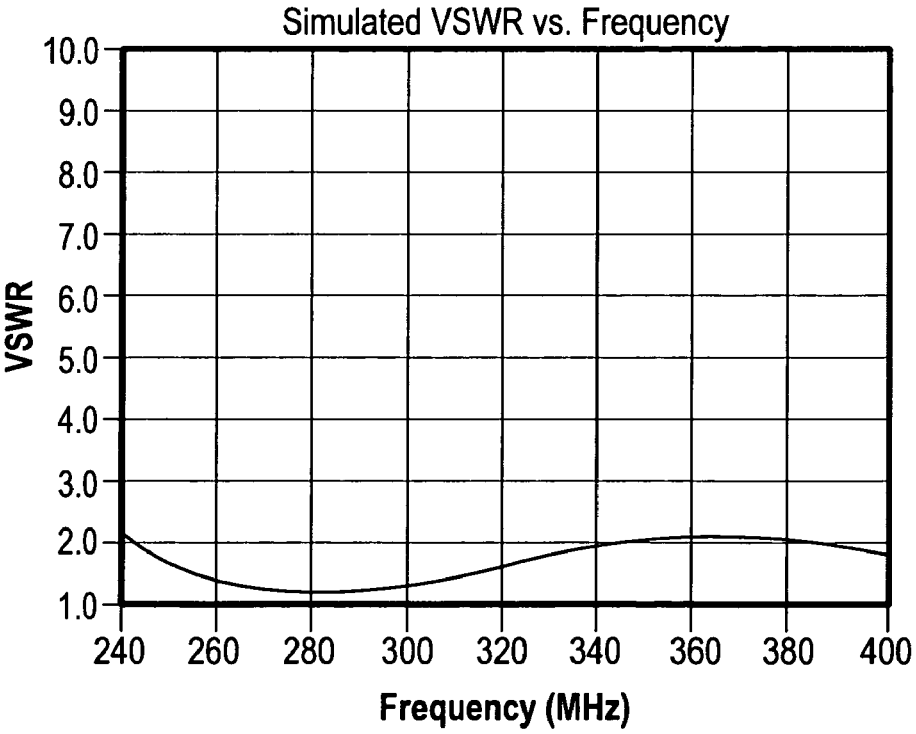
FIG. 9 is a plot of simulated VSWR versus frequency of an antenna apparatus according to one embodiment of the disclosed apparatus and methods.

FIG. 8 shows the experimental (measured) VSWR versus frequency for the single feed UHF SATCOM antenna apparatus 300 of FIGS. 3-6 (having exemplary characteristics listed in center column of Table 1), and FIG. 9 shows the simulated VSWR versus frequency for the single feed UHF SATCOM antenna apparatus 300 of the same configuration. As shown in each of FIGS. 8 and 9, VSWR is less than about 2:1 (reference to 50 Ohms) substantially across the UHF SATCOM band. Thus, FIGS. 8-9 demonstrate that the single feed UHF SATCOM antenna apparatus 300 of FIGS. 3-6 achieves low VSWR across the UHF SATCOM band. For the data of FIG. 8, VSWR was measured with antenna apparatus 300 mounted on a non-metallic composite surface. In the configuration of this embodiment, the antenna apparatus is very efficient, providing for an efficiency of greater than about 90%. Moreover, in this configuration the antenna apparatus 300 provides is compact, lightweight and aerodynamic, having an overall height that is less than about a quarter wavelength (~0.19λ) at the highest useful frequency, and the length of antenna apparatus 300 is less than half wavelength at the highest useful frequency.

Figure 1:
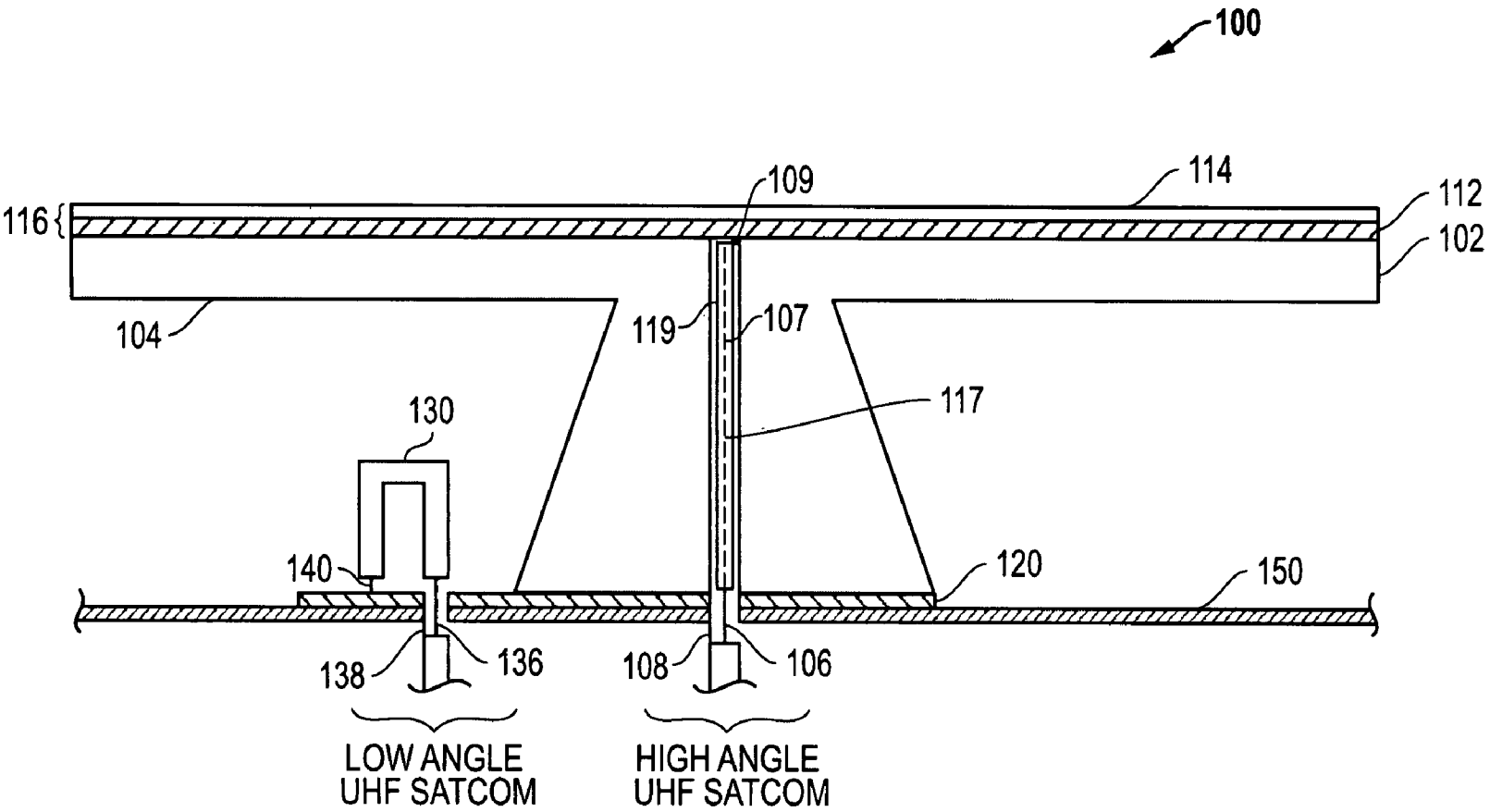
FIG. 1 (Prior Art)
FIG. 1 is a side view of a planar UHF SATCOM antenna device of the prior art.
Figure 10:
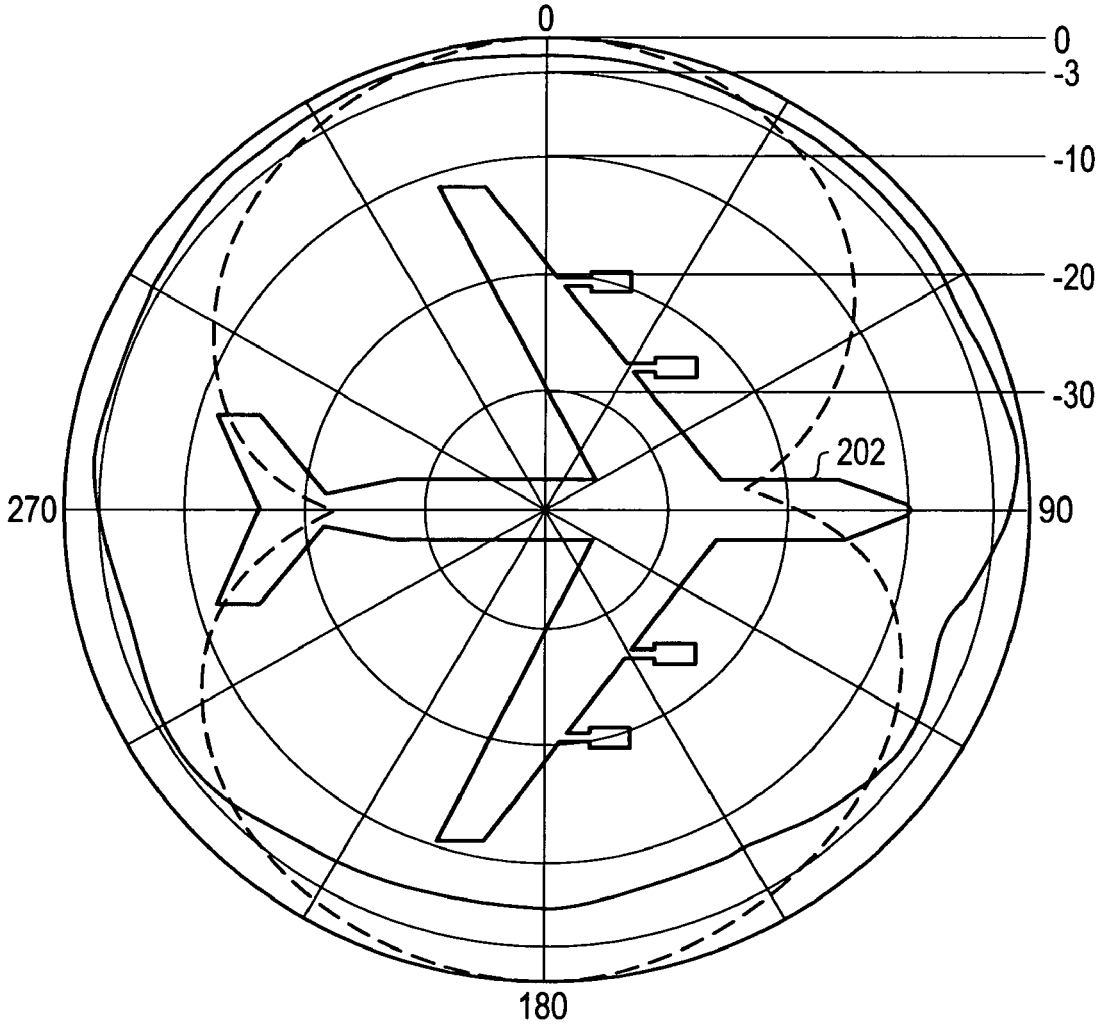
FIG. 10 illustrates radiation pattern performance for an antenna apparatus according to one embodiment of the disclosed apparatus and methods.
Figure 11:
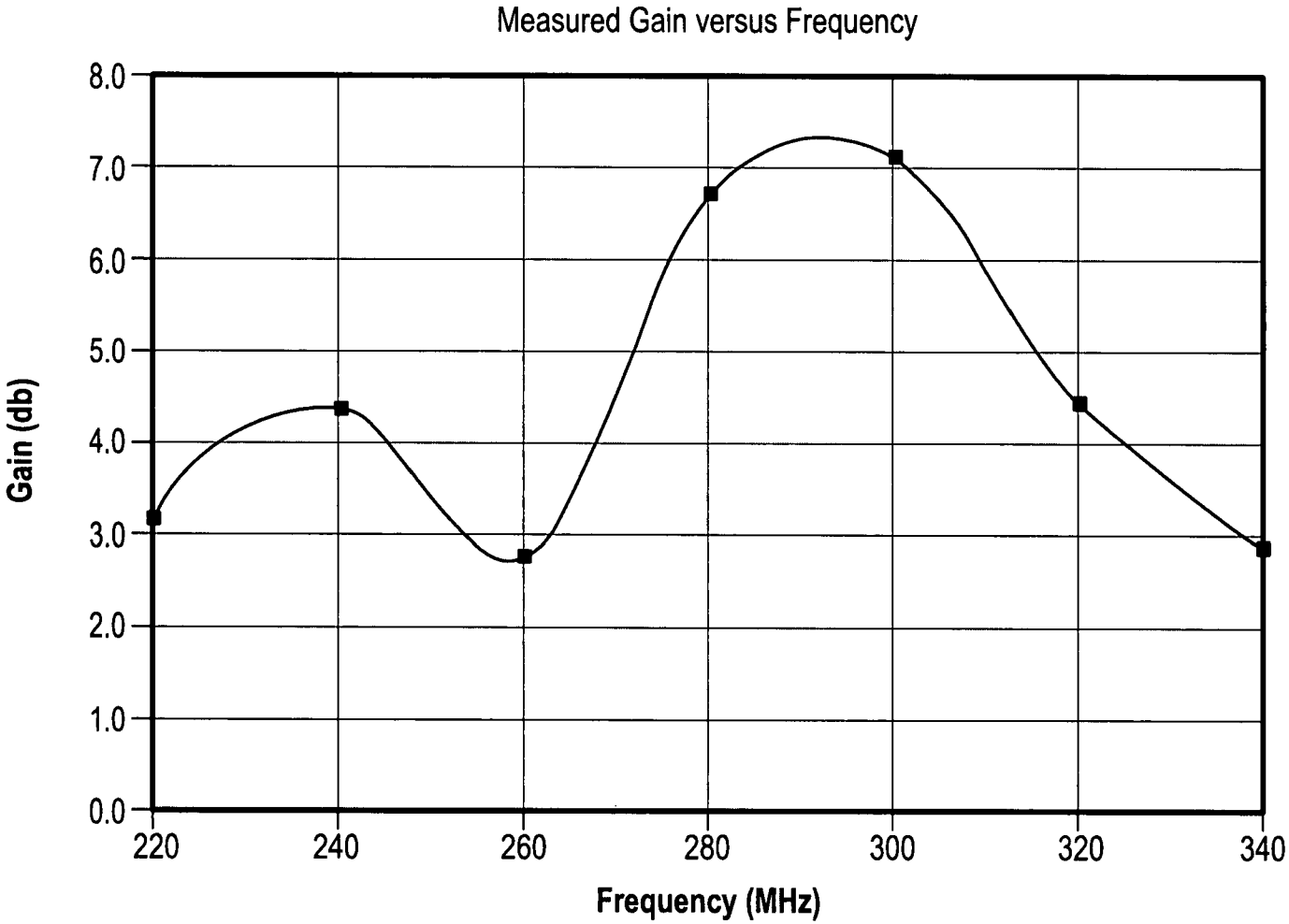
FIG. 11 is a plot of measured gain across the operating frequency band of an antenna apparatus according to one embodiment of the disclosed apparatus and methods.

In one exemplary embodiment, director 326 may be used to match the antenna impedance characteristics to a 50 ohm device, and also to shape the radiating characteristics of the antenna. In such an embodiment, the conductive portions of the antenna apparatus 300 are excited by signals applied to the antenna feed 314 and feed member 320. The result is antenna performance with good omnidirectional gain, and that supports communication functions over the UHF SATCOM frequency band. Antenna apparatus 300 of the disclosed systems and methods may be implemented to provide good high elevation angle radiation patterns for satellite communications and good low elevation angle radiation patterns for line of sight (LOS) communications. In this regard, FIG. 10 provides an illustration of the measured azimuth radiation pattern performance (the solid line plot) for one embodiment of antenna apparatus 300 disclosed herein compared to the radiation pattern performance (the dashed line plot) of prior art high angle UHF SATCOM dipole antenna structure of FIG. 1 when measured in relation to an aircraft fuselage 202. As may be seen in FIG. 10, prior art signal nulls located fore and aft of aircraft fuselage 202 in the radiation pattern of the prior art dipole antenna structure of FIG. 1 are greatly reduced and substantially eliminated in the radiation pattern of antenna apparatus 300 without the presence of a monopole antenna structure. FIG. 11 shows a plot of the measured gain across the operating frequency band of antenna apparatus 300, which illustrate a gain of ~3 dBi or greater across the band.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A vehicle-based ultra high frequency satellite communication (UHF SATCOM) communication system, comprising:

a vehicle having a fuselage with a surface that is non-electrically conductive;

a UHF SATCOM dipole antenna apparatus mounted to the non-conductive vehicle fuselage with no ground plane coupled therebetween, the antenna apparatus comprising:

a first conductive planar antenna element electrically coupled between a single UHF SATCOM feed and a conductive base plate, the first planar antenna element having an inboard leg section coupled between a first end of the first planar element and an outboard leg section of the first planar antenna element, the inboard leg section of the first planar antenna element having a longitudinal axis extending between the first end of the first planar element and the outboard leg section of the first planar element, the single UHF SATCOM feed being electrically coupled to the first end of the first planar antenna element, a second conductive planar antenna element coupled to the conductive base plate in floating relationship to the first planar antenna element with a space therebetween, the second planar antenna element having an inboard leg section coupled between a first end of the second planar element and an outboard leg section of the second planar antenna element, the inboard leg section of the second planar antenna element having a longitudinal axis extending between the first end of the second planar element and the outboard leg section of the second planar element, a single UHF SATCOM ground being electrically coupled to the conductive base plate, and a capacitive director structure having a conductive director and being coupled across the space between the first and second planar antenna elements, the capacitive director structure having a length coextensive with the length of the inboard leg sections of each of the first and second planar antenna elements, the capacitive director structure also having a length only partially extensive with the length of the outboard leg sections of each of the first and second planar antenna elements, wherein the longitudinal axis of the first leg section of the second planar antenna element is oriented substantially parallel to the longitudinal axis of the first leg section of the first planar antenna element in back to back relationship such that the second planar antenna element extends in a direction substantially opposite from a direction in which the first planar element extends, wherein the outboard leg section of the first planar antenna element has a longitudinal axis that extends at an angle ($\alpha$) relative to the longitudinal axis of the inboard leg section of the first planar element, and wherein the outboard leg section of the second planar antenna element has a longitudinal axis that extends at the angle ($\alpha$) relative to the longitudinal axis of the inboard leg section of the second planar element, and wherein the angle ($\alpha$) is operative to provide the antenna apparatus with simultaneous high angle and low angle UHF SATCOM communication capability through the single UHF SATCOM feed when the conductive base plate is coupled to the non-conductive surface of the vehicle with no ground plane coupled therebetween; and a UHF SATCOM communication apparatus mounted to or contained within the vehicle, the UHF SATCOM communication system being coupled to the UHF SATCOM dipole antenna apparatus by the single UHF SATCOM feed, the UHF SATCOM dipole antenna apparatus providing simultaneous high angle and low angle UHF SATCOM communication capability to the UHF SATCOM communication system through the single UHF SATCOM feed.

2. The communication system of claim 1, wherein the vehicle is an aircraft having a fuselage constructed of non-electrically conductive composite materials.

3. The communication system of claim 1, wherein the angle ($\alpha$) has a value that is operative to provide the antenna apparatus with high angle UHF SATCOM communication capability to the UHF SATCOM communication apparatus of from 90 degrees to about 40 degrees above the horizon simultaneous with low angle UHF SATCOM communication capability of from about 40 degrees to about 0 degrees above the horizon through the single UHF SATCOM feed.

4. The communication system of claim 1, wherein the antenna apparatus further comprises:

a first conductive planar antenna base structure coupled between the conductive base plate and the inboard leg section of the first conductive planar antenna element;

a second conductive planar antenna base structure coupled between the conductive base plate and the inboard leg section of the second conductive planar antenna element with a space between the first planar base structure and the second planar base structure; and a conductive center feed member electrically coupled between the UHF SATCOM feed and the first end of the first planar antenna element, the conductive center feed member being disposed in the space between the first planar base structure and the second planar base structure.

5. The communication system of claim 1, wherein the antenna apparatus is configured to have a voltage standing wave ratio (VSWR) that is less than about 2:1 substantially across the UHF SATCOM band of from about 244 MHz to about 318 MHz as referenced to 50 Ohms.

6. The communication system of claim 1, wherein the antenna apparatus has an overall height that is less than about a quarter wavelength at the highest useful frequency of the UHF SATCOM band, and has a length that is less than about half the wavelength at the highest useful frequency of the UHF SATCOM band.

7. A communication method, comprising:

providing a vehicle having a fuselage with a surface that is non-electrically conductive;

providing a UHF SATCOM dipole antenna apparatus mounted to the non-conductive vehicle fuselage with no ground plane coupled therebetween, the antenna apparatus comprising:

a first conductive planar antenna element electrically coupled between a single UHF SATCOM feed and a conductive base plate, the first planar antenna element having an inboard leg section coupled between a first end of the first planar element and an outboard leg section of the first planar antenna element, the inboard leg section of the first planar antenna element having a longitudinal axis extending between the first end of the first planar element and the outboard leg section of the first planar element, the single UHF SATCOM feed being electrically coupled to the first end of the first planar antenna element, a second conductive planar antenna element coupled to the conductive base plate in floating relationship to the first planar antenna element with a space therebetween, the second planar antenna element having an inboard leg section coupled between a first end of the second planar element and an outboard leg section of the second planar antenna element, the inboard leg section of the second planar antenna element having a longitudinal axis extending between the first end of the second planar element and the outboard leg section of the second planar element, a single UHF SATCOM ground being electrically coupled to the conductive base plate, and a capacitive director structure having a conductive director and being coupled across the space between the first and second planar antenna elements, the capacitive director structure having a length coextensive with the length of the inboard leg sections of each of the first and second planar antenna elements, the capacitive director structure also having a length only partially extensive with the length of the outboard leg sections of each of the first and second planar antenna elements, wherein the longitudinal axis of the first leg section of the second planar antenna element is oriented substantially parallel to the longitudinal axis of the first leg section of the first planar antenna element in back to back relationship such that the second planar antenna element extends in a direction substantially opposite from a direction in which the first planar element extends, wherein the outboard leg section of the first planar antenna element has a longitudinal axis that extends at an angle (α) relative to the longitudinal axis of the inboard leg section of the first planar element, and wherein the outboard leg section of the second planar antenna element has a longitudinal axis that extends at the angle (α) relative to the longitudinal axis of the inboard leg section of the second planar element, and wherein the angle (α) is operative to provide the antenna apparatus with simultaneous high angle and low angle UHF SATCOM communication capability through the single UHF SATCOM feed when the conductive base plate is coupled to the non-conductive surface of the vehicle with no ground plane coupled therebetween;

providing a UHF SATCOM communication apparatus mounted to or contained within the vehicle, the UHF SATCOM communication system being coupled to the UHF SATCOM dipole antenna apparatus by the single UHF SATCOM feed, the UHF SATCOM dipole antenna apparatus providing simultaneous high angle and low angle UHF SATCOM communication capability to the UHF SATCOM communication system through the single UHF SATCOM feed; and at least one of transmitting UHF SATCOM communication signals from the UHF SATCOM communication apparatus via the UHF SATCOM dipole antenna apparatus, receiving UHF SATCOM communication signals at the UHF SATCOM communication apparatus via the UHF SATCOM dipole antenna apparatus, or a combination thereof.

8. The method of claim 7, further comprising providing the vehicle as an aircraft having a fuselage constructed of non-electrically conductive composite materials.

9. The method of claim 7, further comprising providing the antenna apparatus as an antenna apparatus in which the angle (α) has a value that is operative to provide the antenna apparatus with high angle UHF SATCOM communication capability to the UHF SATCOM communication apparatus of from 90 degrees to about 40 degrees above the horizon simultaneous with low angle UHF SATCOM communication capability of from about 40 degrees to about 0 degrees above the horizon through the single UHF SATCOM feed.

10. The method of claim 7, further comprising providing the antenna apparatus as an antenna apparatus that comprises:

a first conductive planar antenna base structure coupled between the conductive base plate and the inboard leg section of the first conductive planar antenna element;

a second conductive planar antenna base structure coupled between the conductive base plate and the inboard leg section of the second conductive planar antenna element with a space between the first planar base structure and the second planar base structure; and a conductive center feed member electrically coupled between the UHF SATCOM feed and the first end of the first planar antenna element, the conductive center feed member being disposed in the space between the first planar base structure and the second planar base structure.

11. The method of claim 7, further comprising providing the antenna apparatus as an antenna apparatus that is configured to have a voltage standing wave ratio (VSWR) that is less than about 2:1 substantially across the UHF SATCOM band of from about 244 MHz to about 318 MHz as referenced to 50 Ohms.

12. The method of claim 7, further comprising providing the antenna apparatus as an antenna apparatus that has an overall height that is less than about a quarter wavelength at the highest useful frequency of the UHF SATCOM band, and that has a length that is less than about half the wavelength at the highest useful frequency of the UHF SATCOM band.

13. A vehicle-based ultra high frequency satellite communication (UHF SATCOM) dipole antenna system, comprising:

a vehicle having a fuselage with a surface that is non-electrically conductive; and a UHF SATCOM dipole antenna apparatus mounted to the non-conductive vehicle fuselage with no ground plane coupled therebetween, the antenna apparatus comprising:

a first conductive planar antenna element electrically coupled between a single UHF SATCOM feed and a conductive base plate, the first planar antenna element having an inboard leg section coupled between a first end of the first planar element and an outboard leg section of the first planar antenna element, the inboard leg section of the first planar antenna element having a longitudinal axis extending between the first end of the first planar element and the outboard leg section of the first planar element, the single UHF SATCOM feed being electrically coupled to the first end of the first planar antenna element, a second conductive planar antenna element coupled to the conductive base plate in floating relationship to the first planar antenna element with a space therebetween, the second planar antenna element having an inboard leg section coupled between a first end of the second planar element and an outboard leg section of the second planar antenna element, the inboard leg section of the second planar antenna element having a longitudinal axis extending between the first end of the second planar element and the outboard leg section of the second planar element, a single UHF SATCOM ground being electrically coupled to the conductive base plate, and a capacitive director structure having a conductive director and being coupled across the space between the first and second planar antenna elements, the capacitive director structure having a length coextensive with the length of the inboard leg sections of each of the first and second planar antenna elements, the capacitive director structure also having a length only partially extensive with the length of the outboard leg sections of each of the first and second planar antenna elements;

wherein the longitudinal axis of the first leg section of the second planar antenna element is oriented substantially parallel to the longitudinal axis of the first leg section of the first planar antenna element in back to back relationship such that the second planar antenna element extends in a direction substantially opposite from a direction in which the fist planar element extends;

wherein the outboard leg section of the first planar antenna element has a longitudinal axis that extends at an angle (α) relative to the longitudinal axis of the inboard leg section of the first planar element, and wherein the outboard leg section of the second planar antenna element has a longitudinal axis that extends at the angle (α) relative to the longitudinal axis of the inboard leg section of the second planar element; and wherein the angle (α) is operative to provide the antenna apparatus with simultaneous high angle and low angle UHF SATCOM communication capability through the single UHF SATCOM feed when the conductive base plate is coupled to the non-conductive surface of the vehicle with no ground plane coupled therebetween.

14. The antenna system of claim 13, wherein the angle (α) has a value that is operative to provide the antenna apparatus with high angle UHF SATCOM communication capability of from 90 degrees to about 40 degrees above the horizon simultaneous with low angle UHF SATCOM communication capability of from about 40 degrees to about 0 degrees above the horizon through the single UHF SATCOM feed.

15. The antenna system of claim 13, further comprising:

a first conductive planar antenna base structure coupled between the conductive base plate and the inboard leg section of the first conductive planar antenna element;

a second conductive planar antenna base structure coupled between the conductive base plate and the inboard leg section of the second conductive planar antenna element with a space between the first planar base structure and the second planar base structure; and a conductive center feed member electrically coupled between the UHF SATCOM feed and the first end of the first planar antenna element, the conductive center feed member being disposed in the space between the first planar base structure and the second planar base structure.

16. The antenna system of claim 13, wherein the antenna apparatus is configured to have a voltage standing wave ratio (VSWR) that is less than about 2:1 substantially across the UHF SATCOM band of from about 244 MHz to about 318 MHz as referenced to 50 Ohms.

17. The antenna system of claim 13, wherein the antenna apparatus has an overall height that is less than about a quarter wavelength at the highest useful frequency of the UHF SATCOM band, and has a length that is less than about half the wavelength at the highest useful frequency of the UHF SATCOM band.

* * * * *